United States Patent [19]

Dukes

[11] 4,269,088

[45] May 26, 1981

[54] WRENCH TOOLS FOR CASTELLATED NUTS

[75] Inventor: Bobby W. Dukes, Austin, Tex.

[73] Assignee: N-S-W Corporation, Austin, Tex.

[21] Appl. No.: 75,620

[22] Filed: Sep. 14, 1979

[51] Int. Cl.[3] ..... B25B 13/46

[52] U.S. Cl. ..... 81/57.39

[58] Field of Search ..... 81/57.39, 57.38, 90 C, 81/125, 121 R, 180 R

[56] References Cited

U.S. PATENT DOCUMENTS

| | | | |
|---|---|---|---|
| 1,300,275 | 4/1919 | Johnson | 81/90 C |
| 3,134,291 | 5/1964 | Barry | 81/90 C |
| 3,733,938 | 5/1973 | Smith | 81/121 R |
| 3,970,407 | 7/1976 | Uffman | 81/125 |
| 4,027,560 | 6/1977 | Parker | 81/57.39 |

FOREIGN PATENT DOCUMENTS

| | | | |
|---|---|---|---|
| 807522 | 10/1936 | France | 81/90.4 |

*Primary Examiner*—James L. Jones, Jr.
*Attorney, Agent, or Firm*—Michael P. Breston

[57] ABSTRACT

The power tool is adapted for driving one of a plurality of adjacently-spaced castellated nuts. Each castellated nut has a number of radial slots. Each nut is adapted to connect with a stud having an axial threaded bore. The power tool comprises a wrench driver for turning one of the castellated nuts. A wrench arm extends laterally from the wrench adapter. An anchor assembly is coupled to the wrench driver and includes an anchor adapter. The wrench driver has a head which carries an equal number of radial lugs for operatively engaging the slots in the nut. A retaining cylindrical skirt downwardly extends from the wrench driver's head for capturing therein a portion of the body of the castellated nut while the driver's lugs engage the nut's slots. A retaining bolt threadedly interconnects the wrench driver with the stud carrying the castellated nut prior to exerting power with the power tool, thereby preventing the lugs from disengaging from their mating slots. The construction of the anchor adapter is similar to that of the wrench driver except that the anchor socket does not contain lugs.

5 Claims, 12 Drawing Figures

FIG. 1.
PRIOR ART
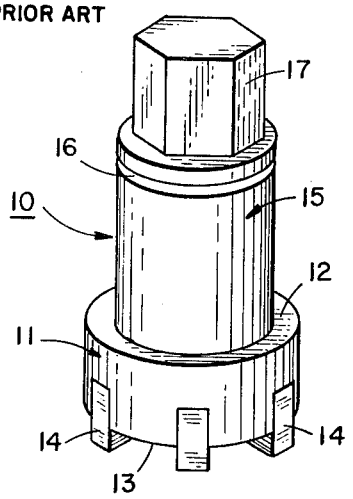
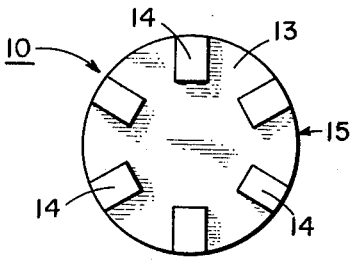
PRIOR ART
FIG. 2.
PRIOR ART
FIG. 3.
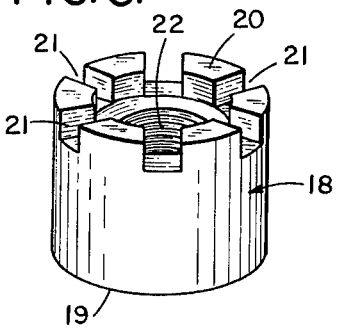
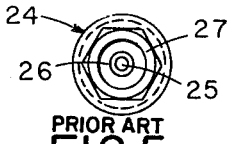
PRIOR ART
FIG. 5.
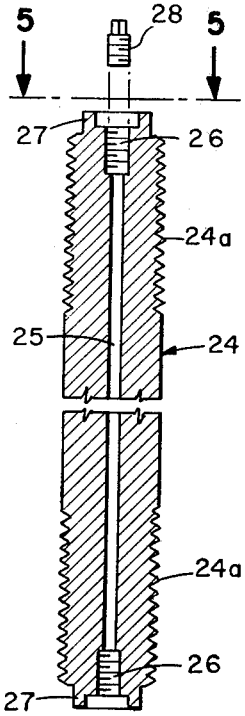
PRIOR ART
FIG. 4.
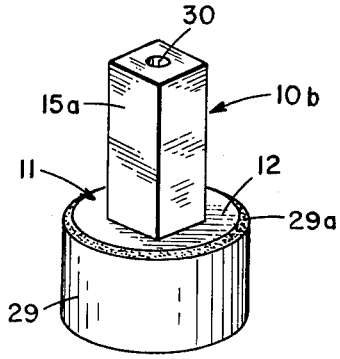
FIG. 9.
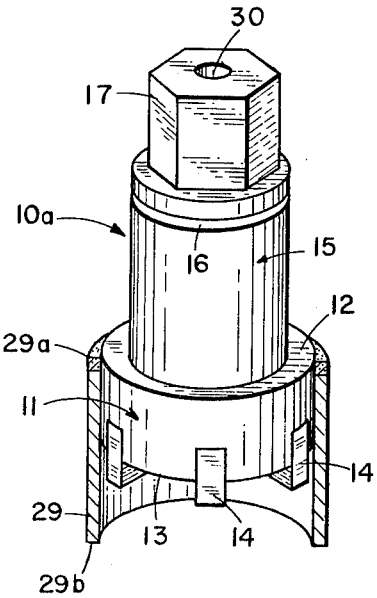
FIG. 6.
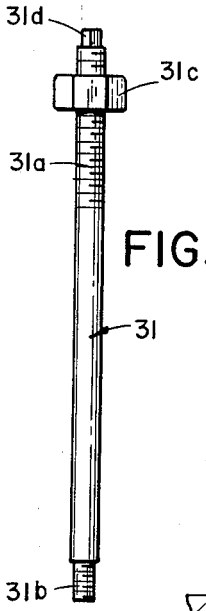
FIG. 7.
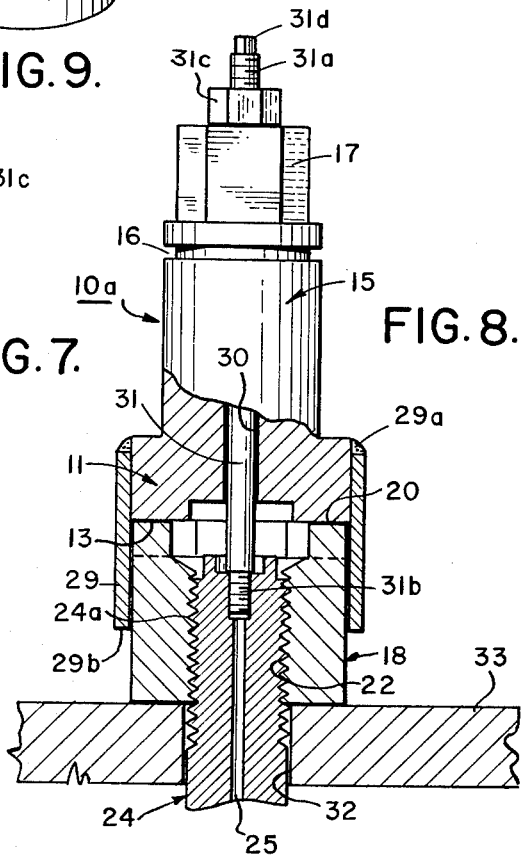
FIG. 8.

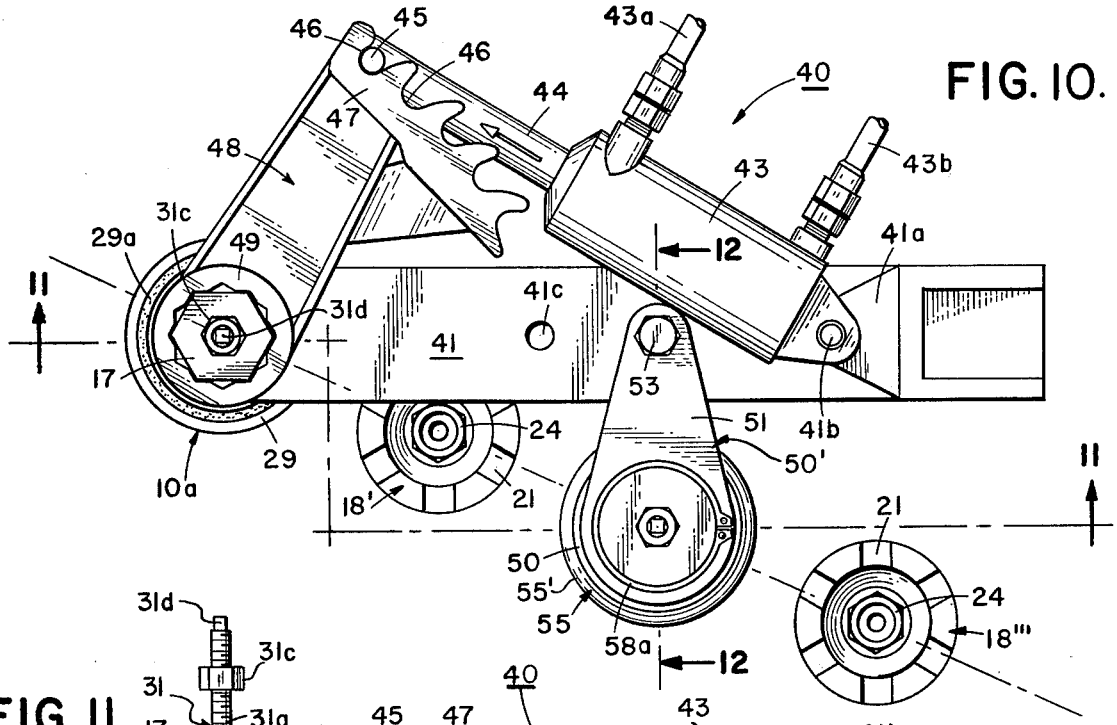
FIG. 10.
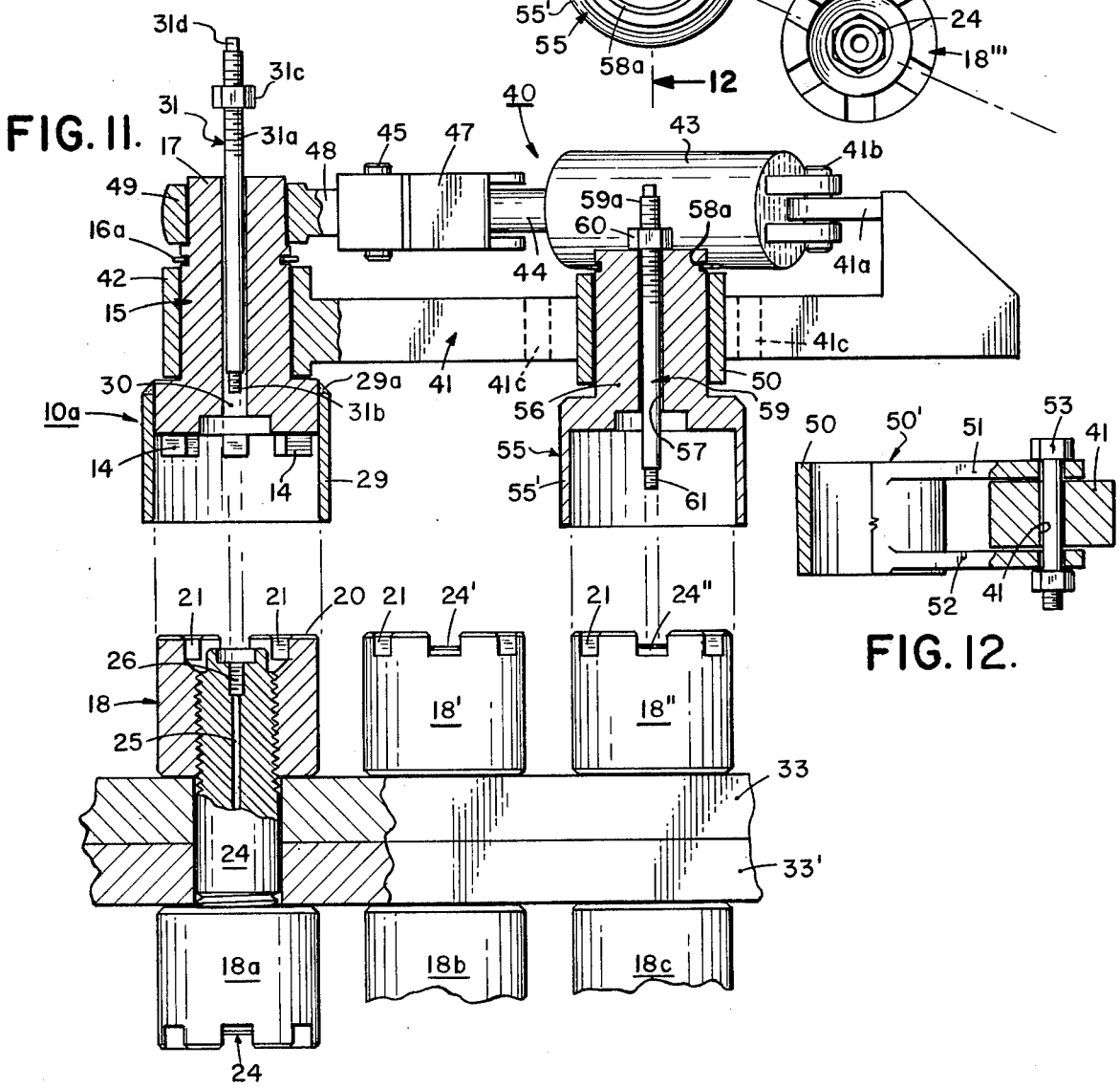
FIG. 11.
FIG. 12.

WRENCH TOOLS FOR CASTELLATED NUTS

BACKGROUND OF THE INVENTION

1. Field of the Invention

This invention generally relates to power wrenches with reaction means adapted for wrenching closely spaced castellated nuts, such as are typically found on flanged connections.

2. Description of the Prior Art

Castellated nuts are used primarily for flanged connections requiring close inter-stud spacings. These nuts become subjected to very high torques during the wrenching operations. The studs used with castellated nuts frequently have an axial test hole adapted to receive a measuring rod for measuring the stretch of the stud which provides a corresponding measurement of the tension in the stud. Such measurements can alert to a possible failure of the flanged connection. A conventional wrench driver for torquing such castellated nuts comprises a wrench head having a plurality of equally-spaced radial lugs adapted for matingly engaging the radial slots of the castellated nuts. In use, due to the high driving torques exerted on the nuts through the slots, and on geometrical irregularities in the shapes of the slots and/or the lugs, the lugs when under torque tend to disengage from the slots by rising up on the walls of the slots. Any such disengagement between the driving lugs and their mating slots may cause serious damage to the walls of the slots and of the lugs. In addition, such disengagement considerably increases the total time required for turning and loosening the castellated nuts.

SUMMARY OF THE INVENTION

The power tool is adapted for successively driving one of a plurality of adjacently-spaced castellated nuts. The tool comprises a wrench driver for driving one of the castellated nuts. A wrench arm extends laterally from the wrench driver. An anchor assembly is coupled to the wrench driver. The anchor assembly comprises an anchor ring rotatably mounted on the wrench driver, an anchor socket positionable over an adjacent one of the castellated nuts, and a reaction beam having one end coupled to the anchor ring and another end coupled to the anchor adapter. Each castellated nut has a number of radial slots. Each nut is adapted to connect with a stud having an axial threaded bore. The wrench driver has a head which carries an equal number of radial lugs for operatively engaging the slots in the nut. A retaining cylindrical skirt downwardly extends from the wrench driver's head for capturing therein a portion of the body of the castellated nut while its lugs engage the slots in the nut. A retaining bolt threadedly interconnects the wrench driver with the stud carrying the castellated nut prior to exerting power with the power tool, thereby preventing the lugs from disengaging from their mating slots. The construction of the anchor adapter is similar to that of the wrench driver, except that the anchor adapter does not contain lugs. A retaining bolt preferably also connects the anchor adapter with the anchor nut to its stud.

BRIEF DESCRIPTION OF THE DRAWINGS

FIG. 1 is a perspective view of a prior art wrench driver for wrenching castellated nuts;

FIG. 2 is a bottom view of the driver shown in FIG. 1;

FIG. 3 is a perspective view of a typical castellated nut;

FIG. 4 is a vertical sectional view of a typical stud used with castellated nuts on some flanged connections;

FIG. 5 is a top view on line 5—5 of the stud shown in FIG. 4;

FIG. 6 is an isometric view of the improved wrench driver of the invention with the retainer skirt cut in half to show the radial lugs;

FIG. 7 is an elevational view of the retainer rod used in conjunction with the improved driver shown in FIG. 6;

FIG. 8 is an elevational view, partly in section, showing the novel wrench driver of the invention is operative position on a castellated nut and locked thereto with the retainer skirt and with the retainer rod shown in FIG. 7;

FIG. 9 is an isometric view of a wrench driver in accordance with another embodiment of the invention;

FIG. 10 is a plan view of a power wrench tool for applying a loosening torque to a castellated nut with the novel wrench driver of the invention, using the novel anchor socket of the invention positioned on an adjacent such nut;

FIG. 11 is an exploded view, partly in section, taken along line II—II of FIG. 10; and FIG. 12 is a view, partly in section, taken along line 12—12 of FIG. 10.

DESCRIPTION OF THE PREFERRED EMBODIMENTS

In FIGS. 1–5 is shown a prior art wrench driver, generally designated as 10, for turning a standard castellated nut, generally designated as 18, typically threaded on a standard stud, generally designated as 24, used on flanged connections, such as for turbines, etc.

Driver 10 comprises a solid disc-shaped head, generally designated as 11, having a top face 12 and a bottom flat face 13. A plurality of equally-spaced, radial lugs 14 project downwardly from the flat face 13. A hub member, generally designated as 15, extends vertically upwardly from head 11 and carries a hex 17 to be driven by the wrench socket of a power tool 40 (FIG. 10). Hub 15 is provided with an annular groove 16 for securing the wrench driver 10 to the wrench socket.

The castellated nut 18 has a cylindrical configuration provided with a flat bottom face 19 and a castellated annular top shoulder 20 having equally-spaced, radial slots 21. The threaded longitudinal center bore 22 in nut 18 receives the threaded end 24*a* of stud 24 (FIG. 8).

A longitudinal test hole 25 extends throughout the entire length of stud 24. Hole 25 is normally terminated at each end with a slightly larger diameter threaded bore 26 (FIG. 4) for receiving therein a threaded plug 28 thereby keeping out foreign matter from hole 25. The outermost ends 27 of stud 24 are hex-shaped, as shown in FIG. 5, and are adapted to be turned with a wrench socket (not shown) for hand threading a castellated nut onto each end 24*a* of stud 24, prior to power wrenching such nuts with power tool 40.

The test hole 25 receives a measuring tool (not shown) which measures the length of the stud before and after nut 18 is power wrenched. Such length measurement is indicative of the stretch sustained by stud 24 as a result of the power wrenching operation. The stretch measurement provides a quantitative measurement of the tension in the stud as a result of the power wrenching operation.

FIGS. 6–8 show the improved wrench driver, generally designated as 10*a*, of this invention. Throughout the drawings identical parts will be indicated with identical reference characters, and similar parts will be indicated with the same reference characters followed by a prime (') to facilitate the description thereof. It will be noted that the improved wrench driver 10*a* of this invention is provided with a retainer skirt 29 whose upper end can be welded to head 11, as at 29*a*. The inner diameter of sleeve 29 is of slightly larger diameter than the outer diameter of the cylindrical castellated nut 18. The free end 29*b* of sleeve 29 extends to a length which is about half the length of the castellated nut 18 (FIG. 8).

The entire body of the wrench driver 10*a* has a longitudinal center hole 30 adapted to receive therein a retainer bolt 31 which is threaded at its upper end portion as at 31*a* and at its bottom end as at 31*b*. A retainer nut 31*c* is threadedly connected to portion 31*a*. The tip of bolt 31 has a square head 31*d* for receiving a drive socket (not shown).

First nut 18 is hand threaded in position on the bolt 24 which extends through bore 32 of a flange plate 33. In operative position on a castellated nut 18 (FIG. 8), the lower face 13 of the driver's head 11 abuts against the annular shoulder 20 on the castellated nut 18, and its lugs 14 are positioned in and engage the walls of the nut's radial slots 21. Skirt 29 fits snugly around the body of the castellated nut 18, thereby preventing lateral displacement between lugs 14 and slots 21. The retainer bolt 31 is inserted through hole 30 into the wrench driver 10*a*. The end 31*b* of bolt 31 is threadedly connected into the threaded bore 26 of stud 24. Retainer nut 31*c* is then tightened on the threaded end 31*a* of bolt 31 until it snugly abuts the top face of the hex 17. In this manner, the wrench driver 10*a* and nut 18 become longitudinally locked to each other and to stud 24.

In FIG. 9 is shown a modified wrench driver, generally designated as 10*b*, having a square hub 15*a* instead of a cylindrical hub 15. In all other respects, the wrench driver 10*b* is similar to the driver socket 10*a*.

The driver-nut assembly (10*a*, 18) is now ready for being wrenched by the power wrench tool 40 as will now be described with reference to FIGS. 10–12.

The wrench driver 10*a* can be wrenched with any suitable power wrench tool. A preferred power wrench tool is more particularly described in U.S. Pat. No. 4,027,560, assigned to the same assignee. The tool 40 is especially adapted to rapidly turn the castellated nuts 18, 18', 18'' (FIG. 11) which are threadedly connected to studs 24 extending through two flange plates 33, 33'. The opposite ends of the studs 24 carry corresponding castellated nuts 18*a* –18*c*.

The wrench tool 40 comprises a reaction support bar 41 having a ring 42 formed on one end thereof for rotatably receiving the cylindrical hub 15 of driver 10*a*. The driver 10*a* is retained in ring 42 by a retainer 16*a* positioned in groove 16. The opposite end of the reaction bar 41 is provided with a raised plate 41*a* containing a pivot pin 41*b*. The end casing of a hydraulic cylinder 43 is pivotably mounted on pin 41*b*. The hydraulic cylinder 43 has a pair of fluid conduits 43*a*, 43*b* for alternatingly supplying fluid power to the hydraulic cylinder 43. Piston rod 44 of hydraulic cylinder 43 has at its outer end a drive pin 45 which step-wise engages a plurality of arcuately-spaced drive slots 46 in a plate member 47 attached to the free end of a wrench arm 48, as more fully described in said U.S. Pat. No. 4,027,560.

The other end of the wrench arm 48 is provided with a hex socket 49 for engaging the hex head 17 of the hub 15 of driver 10*a*. The power wrench tool 40, as shown, is in position for loosening the castellated nut 18. If tightening of the castellated nuts is desired, the wrench arm 48 is turned 180° from the position shown in FIG. 10.

An anchor arm 50' having at its outer end a ring 50 and at its inner end a pair of parallel clevis plates 51, 52, is pivotably attached to the reaction bar 41 by a bolt 53 extending through one of several longitudinally-spaced holes 41*c* in bar 41. An anchor adapter, generally designated as 55, similar in shape to the driver 10*a*, is provided with a hub 56 which is rotatably received within ring 50. The adapter 55 has a socket 55' which can be mounted over one of the adjacent castellated nuts, such as nut 18'', in a manner similar to skirt 29 of the drive socket 10*a*. The free end of hub 56 of adapter 55 has a groove for receiving therein a retainer ring 58*a*. The anchor adapter 55 is retained in place on nut 18'' by socket 55' and the retainer ring 58*a*. It will be noted that the anchor adapter 55 does not include any drive lugs 14, as in the wrench driver 10*a*.

The anchor adapter 55 is also provided with a longitudinal center hole 57, similar to hole 30 of the driver 10*a*, for receiving therein a retainer bolt 59 having a lower threaded end 61 for becoming threadedly connected with the threaded bore 26 of the stud 24 connected to nut 18''. The upper threaded end 59*a* of retainer bolt 59 has a retainer nut 60. It will be appreciated that the retainer bolt 59 firmly secures adapter 55 to stud 24 in a longitudinal direction, and socket 55' prevents lateral displacement between adapter 55 and nut 18''. The bolt 31 and skirt 29 work in a similar fashion for driver 10*a* and nut 18.

What is claimed is:

1. A power tool for rotating one of a plurality of adjacently positioned castellated nuts threadedly connectable to studs, each nut having a body defining a plurality of radial slots therein, and each stud having a threaded axial hole, said tool comprising:

(1) a wrench driver positionable over one threaded castellated nut for transmitting a torque thereto, said wrench driver having
  (a) a head,
  (b) a plurality of radial lugs extending outwardly from said head for engaging the corresponding radial slots in said castellated nut,
  (c) a skirt extending outwardly from said head for capturing a portion of the body of the castellated nut being torqued;

(2) a reaction-support beam having a ring loosely receiving said wrench driver therethrough for free relative rotations therebetween in the clockwise and counter-clockwise directions;

(3) a fluid-operated cylinder mounted over and being pivotably coupled to said beam, said cylinder having a reciprocating ram;

(4) means operatively coupling said ram to said wrench driver for transmitting a torque thereto;

(5) an anchor adapter having a socket anchorable over the body of an adjacent castellated nut, and having an axial bore therethrough;

(6) means movably coupling said anchor adapter to said beam, whereby said fluid-operated cylinder can exert a torque on said one threaded castellated nut through said wrench driver; and (7) a retainer bolt extending through said bore into said threaded hole of said stud for longitudinally interconnecting said anchor adapter to said adjacent nut.

2. A power tool for rotating one of a plurality of adjacently positioned castellated nuts threadedly connectable to studs, each nut having a body defining a plurality of radial slots therein, and each stud having a threaded axial hole, said tool comprising:

(1) a wrench driver positionable over one threaded castellated nut for transmitting a torque thereto, said wrench driver having an axial bore extending therethrough, and said wrench driver including
(a) a head,
(b) a plurality of radial lugs extending outwardly from said head for engaging the corresponding radial slots in said castellated nut,
(c) a skirt extending outwardly from said head for capturing a portion of the body of the castellated nut being torqued;

(2) a reaction-support beam having a ring loosely receiving said wrench driver therethrough for free relative rotations therebetween in the clockwise and counter-clockwise directions;

(3) a fluid-operated cylinder mounted over and being pivotably coupled to said beam, said cylinder having a reciprocating ram;

(4) means operatively coupling said ram to said wrench driver for transmitting a torque thereto;

(5) an anchor adapter having a socket anchorable over the body of an adjacent castellated nut;

(6) means movably coupling said anchor adapter to said beam, whereby said fluid-operated cylinder can exert a torque on said one threaded castellated nut through said wrench driver; and (7) a retainer bolt extending through said bore into said threaded hole of said stud, whereby said bolt prevents said wrench driver and said one castellated nut from moving relative to each other in a longitudinal direction and said skirt prevents movement therebetween in a lateral direction.

3. A wrench driver for torquing a castellated nut having a body defining a plurality of radial slots therein, said nut being adapted to become threaded on a stud having a threaded axial hole, said wrench driver comprising:

a head having a plurality of radial lugs outwardly extending from said head and being adapted to engage the slots in said nut;

a skirt outwardly extending from the outer periphery of said head for capturing therein a portion of the body of said castellated nut;

a retainer bolt; and said wrench driver having an axial bore for receiving said retainer bolt therethrough thereby threadedly securing said wrench driver and said nut to the wall of said hole in said stud.

4. A wrench driver for wrenching one of a plurality of castellated nuts threadedly connected on adjacently positioned studs, each nut having a body defining a plurality of radial slots therein, each stud having an axial threaded hole, said driver comprising:

a cylindrical head having at its bottom end face a number of outwardly projecting radial lugs for operatively engaging said slots in said castellated nut;

a skirt outwardly projecting from the cylindrical periphery of said head, said skirt having a bore whose inner diameter is slightly larger than the diameter of said castellated nut to freely receive a portion of said nut in said bore of said skirt;

a coaxial hub extending from said head, said hub having means to engage the socket of a power wrench for torquing said wrench driver; and means removably securing said wrench driver and said castellated nut to said stud.

5. The wrench driver of claim 4, wherein said means is a retainer bolt being threadedly connected with said threaded hole in said stud.

* * * * *